US006163929A

United States Patent [19]

Bradley

[11] Patent Number: 6,163,929

[45] Date of Patent: Dec. 26, 2000

[54] VEHICLE DOOR HINGE

[75] Inventor: Scott Bradley, Ettingshall, United Kingdom

[73] Assignee: UPF (UK) Limited, United Kingdom

[21] Appl. No.: 09/017,007

[22] Filed: Feb. 2, 1998

[30] Foreign Application Priority Data

Jan. 31, 1997 [GB] United Kingdom ..... 9702003

[51] Int. Cl.[7] ..... E05D 5/12

[52] U.S. Cl. ..... 16/380; 16/381; 16/386

[58] Field of Search ..... 16/380, 381, 386

[56] References Cited

U.S. PATENT DOCUMENTS

| | | | |
|---|---|---|---|
| 462,204 | 10/1891 | Clark | 16/380 |
| 2,500,481 | 3/1950 | Adler et al. | 16/380 |
| 3,390,419 | 7/1968 | Foltz | 16/380 |
| 4,116,514 | 9/1978 | Lawrence | 16/380 |
| 4,475,266 | 10/1984 | Suska | 16/380 |
| 4,573,239 | 3/1986 | Valenti et al. | 16/380 |
| 4,790,047 | 12/1988 | Myslicki | 16/381 |
| 4,854,009 | 8/1989 | Brockhaus | 16/381 |

*Primary Examiner*—Anthony Knight
*Assistant Examiner*—Mark Williams
*Attorney, Agent, or Firm*—Kilpatrick Stockton

[57] ABSTRACT

A hinge having a first hinge leaf hingedly connected to a second hinge leaf for movement about a hinge axis, the hinge leaves being inter-engaged to prevent axial separation along the hinge axis, and at least one hinge pin extending along the hinge axis, the hinge pin having a terminal axial face located internally of one of the hinge leafs to prevent access thereto.

1 Claim, 2 Drawing Sheets

VEHICLE DOOR HINGE

The present invention relates to a hinge, in particular, a vehicle door hinge.

Security vehicles as used for example for transporting money to/from banks need to be adapted such that forced entry into the vehicle is difficult.

Hinges, particularly hinges having hinge pins located on the outside of a vehicle can provide a relatively easy access route for forced entry by unauthorised removal of the hinge pin(s).

A general aim of the present invention is to provide a hinge which is difficult to dismantle by removal of the hinge pin.

According to one aspect of the invention there is provided a hinge having a first hinge leaf hingedly connected to a second hinge leaf for movement about a hinge axis, the hinge leaves being inter-engaged to prevent axial separation along the hinge axis, and at least one hinge pin extending along the hinge axis, the hinge pin having a terminal axial face located internally of one of the hinge leafs to prevent access thereto.

Preferably the hinge pin has an enlarged head portion which is housed internally within one of the hinge leaves.

Various aspects of the present invention are hereinafter described with reference to the accompanying drawings in which.

Figure 1:
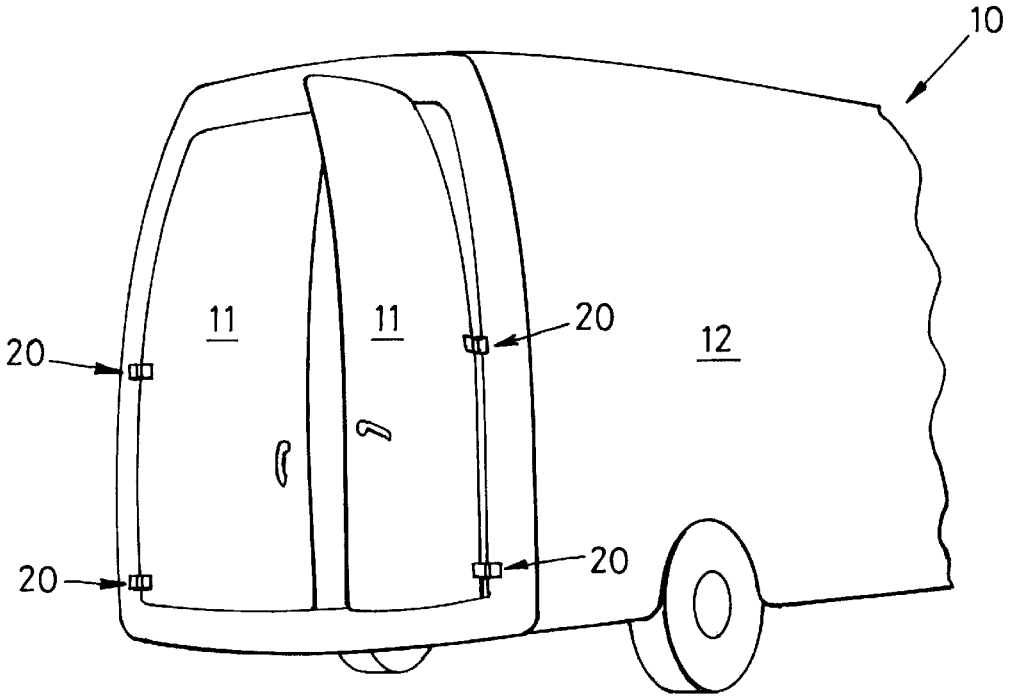
FIG. 1 is a schematic perspective view of the rear of a vehicle fitted with hinges according to the present invention.

Referring initially to FIG. 1, there is shown a vehicle 10 having a pair of rear doors 11. Each door 11 is hingedly connected to the vehicle body 12 via a pair of hinges 20 according to the present invention.

As seen in FIG. 1, the hinges 20 are located externally of the vehicle door 11 and body 12 and so are exposed to tampering by a potential intruder for unauthorised entry into the vehicle.

In accordance with the general aim of the present invention, each hinge 20 is adapted to deter tampering for unauthorised entry.

Figure 3:
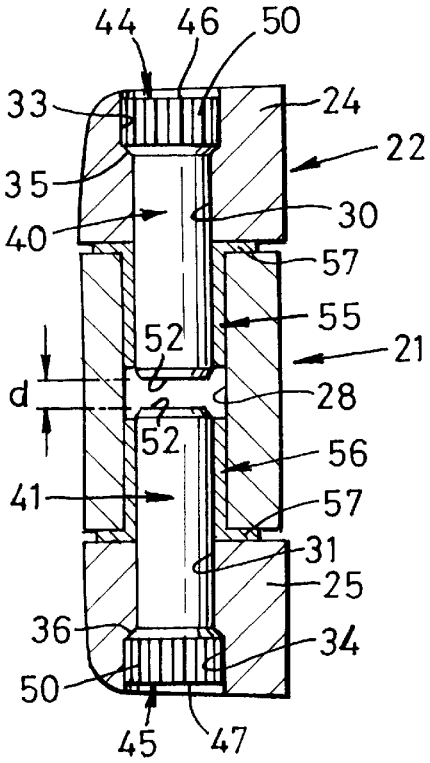
FIG. 3 is a sectional view along line III—III in FIG. 2.
Figure 2:
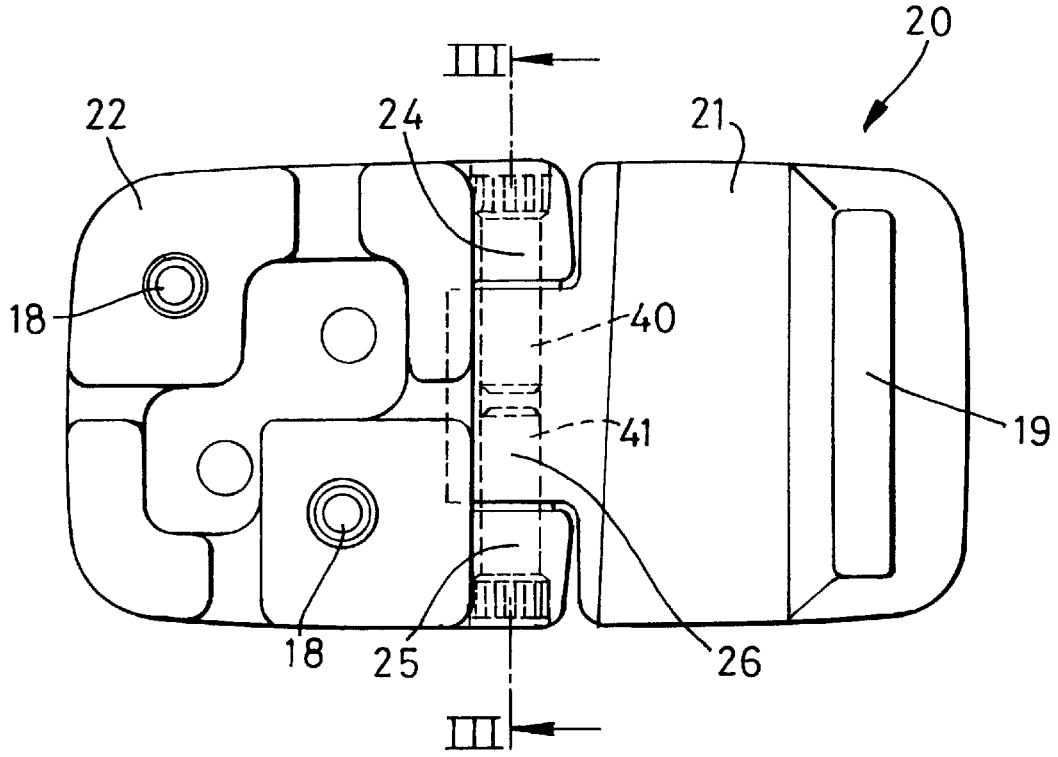
FIG. 2 is a side view of a hinge according to one embodiment of the present invention.
Figure 4:
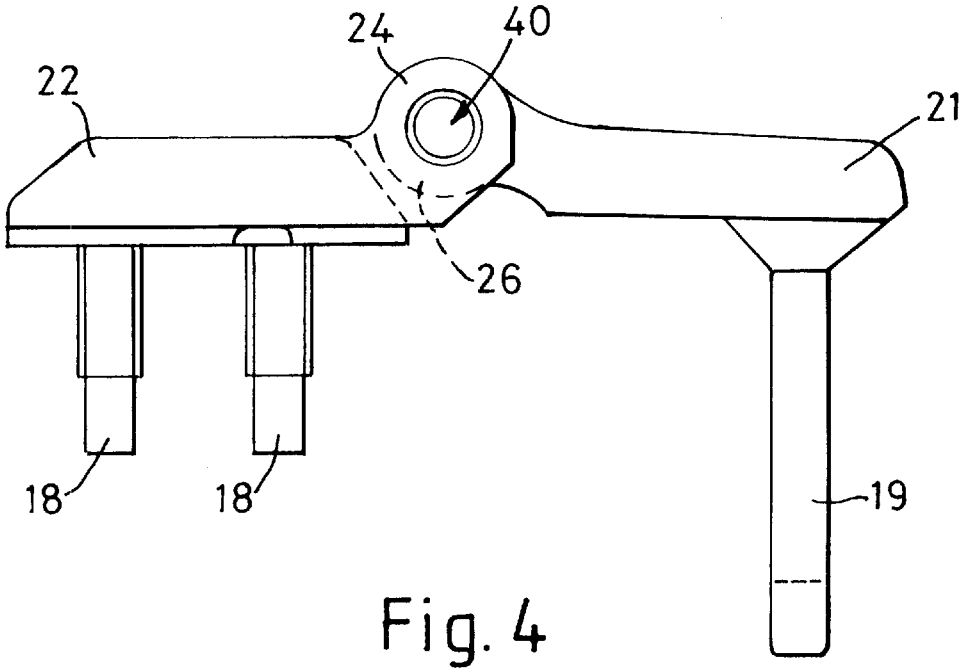
FIG. 4 is a plan view of the hinge shown in FIG. 2.

As seen more clearly in FIGS. 2 to 4, the hinge 20 includes a pair of hinge leaves 21, 22 hingedly connected to another. In the illustrated embodiment, hinge leaf 21 is intended to be secured to the vehicle door 11 and hinge leaf 22 is intended to be secured to the vehicle body 12. Hinge leaf 22 is provided with bolts 18 for securance to the body 12 and hinge leaf 21 is provided with an anchor plate 19 for securance to a door 11.

Hinge leaf 22 includes a pair of spaced journal arms 24, 25 between which is received a journal arm 26 formed on leaf 21.

A bore 28 is provided in arm 26 which extends throughout the entire axial length of arm 26. Journal arms 24, 25 are provided with axially aligned bores 30, 31 respectively which extend the entire axial length of each respective arm 24, 25.

Each bore 30, 31 is stepped to define a wider portion 33, 34 located at the outer end of each respective bore and also to define an internal shoulder 35, 36 respectively.

A pair of hinge pins 40, 41 are provided, hinge pin 40 being located in bore 30 and extending partly into bore 28 from an upper end thereof and hinge pin 41 being located in bore 31 and extending partly into bore 28 from a lower end thereof.

Each hinge pin 40, 41 is provided with an enlarged head 44, 45 respectively, each of which, in use, abuts against respective internal shoulders 35, 36. The axial length of each head 44, 45 is preferably chosen to be equal to or more preferably shorter than the axial length of the wider bore portion such that when in abutment with respective shoulders 35, 36 the head 44, 45 is completely housed within respective bore portion 33, 34. Accordingly, in use, only axial end faces 46, 47 of respective pin heads 44, 45 are accessible to a potential intruder.

Preferably at least the heads 44, 45 are adapted, for example by suitable choice of metal or surface treatment, to be resistive to drilling. For example, the pins 40, 41 may be made of mild steel which is case hardened.

The length of pins 40, 41 are chosen such that their respective inner axial faces 52 are spaced from one another by a distance d when fully inserted. This ensures that each pin 40, 41 may be fully inserted to engage their respective shoulders 35, 36.

Preferably each hinge pin 40, 41 is secured within respective bore 30, 31 so as to be non rotatably received therein and also resistive to axial withdrawal. Preferably such securance is achieved by providing the circumferential faces of heads 44, 45 with a roughened surface which grips the internal wall of respective bore portions 33, 34 after insertion of the pins. The roughened surface may be defined for example by flutes 50 which preferably bite into the material of the hinges leaves during insertion.

It will be appreciated that the hinge pins 40, 41 are inserted into the hinge 10 in opposed axial directions, viz. as shown in FIG. 3 hinge pin 40 is inserted downwardly and hinge pin 41 is inserted upwardly. Accordingly one hinge pin acts to block access to the inner axial face 52 of the other hinge pin and thereby prevent potential intruders from extracting either pin by pushing an implement against inner axial face 52.

Preferably as shown, bore 28 is lined with a pair of self lubricating bushes 55, 56 each of which includes a flange 57 for providing a sliding bearing face between opposed faces on arms 24, 25 and 26.

Figure 5:
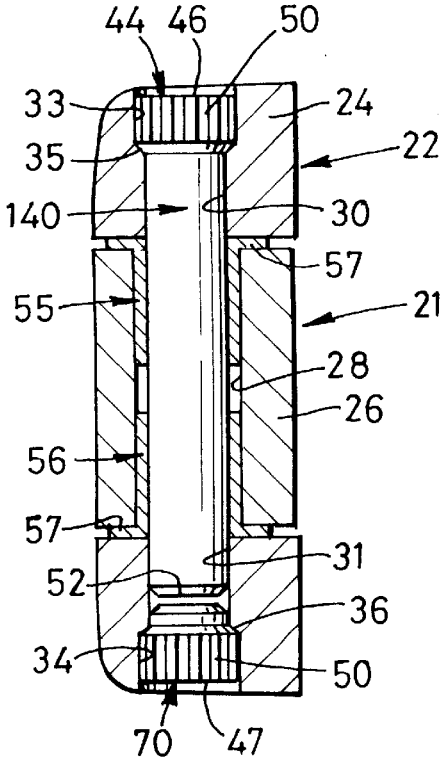
FIG. 5 is a view similar to FIG. 2 showing another embodiment according to the present invention.

A modification is illustrated in FIG. 5 wherein similar parts have been designated by the same reference numerals.

In FIG. 5, a simple hinge pin 140 is provided which extends downwardly through bore 28 and into bore 31. A cap member 70 of similar construction to the head 45 of hinge pin 41 is located within the wide bore portion 34 in order to block access to the inner axial end face 52 of the hinge pin 140.

It will be appreciated that cap member 70 serves to close the outer end of bore 31 and that instead of providing cap member 70, bore 31 may be instead formed as a blind bore.

In the example described above, interleafing between hinge leaves 21 and 22 is achieved by a single journal arm on leaf 21 and a pair of spaced journal arms on leaf 22. It will be appreciated that interleafing may be achieved by adopting a plurality of journal arms on leaf 21, each of which is interleafed with a pair of axially spaced journal arms on leaf 22. In such a case, the outermost journal arms on leaf 22 would be provided with the stepped bores.

What is claimed is:

1. A hinge resistive to unauthorized tampering, the hinge having a first hinge leaf hingedly connected to a second hinge leaf for movement about a hinge axis, the hinge leaves being inter-engaged to prevent axial separation along the hinge axis, and at least one hinge pin extending along the hinge axis, the hinge pin having a terminal axial end face located internally of one of the hinge leafs, comprising:

the first hinge leaf including a first journal arm and the second hinge leaf including a pair of second journal arms spaced apart along the hinge axis, said first journal arm being located between said pair of second journal arms in order to prevent axial separation between the first and second hinge leaves, the first and second journal arms having bores aligned along the hinge axis and receiving said at least one hinge pin;

the bore extending through one of said second journal arms being stepped to define a wide bore portion and a shoulder, the wide bore portion being of a predetermined length defined between said shoulder and an external mouth of the bore, said bores containing said at least one hinge pin having a shank portion and an enlarged head portion, the enlarged head portion being located within the wide bore portion and co-operating with said shoulder to prevent axial displacement of said at least one hinge pin in the insertion direction of the hinge pin, said bore being closed to prevent access to said terminal axial end face of said at least one hinge pin;

the bore extending through each of said second journal arms being stepped to define a wide bore portion and a shoulder, the wide bore portion of each of said bores being of a predetermined axial length defined between said shoulder and the external mouth of the bore;

said at least one hinge pin comprising a first hinge pin having an enlarged head portion and a shank portion located within the bore of one of said second journal arms, and a second hinge pin having an enlarged head portion and a shank portion located within the bore of the other of said second journal arms;

the enlarged head portions of the first and second hinge pins being resistive to drilling and being located within the wide bore portions of the bores of the respective second journals and co-operating with the respective shoulders to prevent axial displacement of the hinge pin in the hinge pin insertion direction; and each shank portion of the respective hinge pins extending partially into the bore of the first journal arm.

* * * * *